US011330906B1

(12) United States Patent
Tsai

(10) Patent No.: US 11,330,906 B1
(45) Date of Patent: May 17, 2022

(54) FOLDING CHAIR

(71) Applicant: SPORT DIVERSIONS INC., Taipei (TW)

(72) Inventor: Wen-Hao Tsai, New Taipei (TW)

(73) Assignee: SPORT DIVERSIONS INC., Taipei (TW)

( * ) Notice: Subject to any disclaimer, the term of this patent is extended or adjusted under 35 U.S.C. 154(b) by 0 days.

(21) Appl. No.: 17/320,233

(22) Filed: May 14, 2021

(30) Foreign Application Priority Data

Apr. 14, 2021 (CN) ..... 202110401266.7

(51) Int. Cl.
*A47C 4/26* (2006.01)
*A47C 4/03* (2006.01)
*A47C 4/16* (2006.01)

(52) U.S. Cl.
CPC ..... *A47C 4/26* (2013.01); *A47C 4/03* (2013.01); *A47C 4/16* (2013.01)

(58) Field of Classification Search
CPC .. A47C 4/26; A47C 4/22; A47C 4/283; A47C 4/03; A47C 4/286; A47C 4/16
USPC ..... 297/45, 16.2, 281, 258.1
See application file for complete search history.

(56) References Cited

U.S. PATENT DOCUMENTS 10,455,942 B2 * 10/2019 Chen ..... A47C 4/02

FOREIGN PATENT DOCUMENTS

CN 212995495 U * 4/2021

* cited by examiner

*Primary Examiner* — Milton Nelson, Jr.

(57) ABSTRACT

A folding chair includes a left central support rod, left front support rod, left rear support rod, left central leg terminal, left front leg terminal, left rear leg terminal, left limiting element, left sliding element, left limiting sliding element, left connecting element, right central support rod, right front support rod, right rear support rod, right central leg terminal, right front leg terminal, right rear leg terminal, right limiting element, right sliding element, right limiting sliding element, right connecting element, first connecting rod, second connecting rod, third connecting rod, fourth connecting rod, fifth connecting rod, sixth connecting rod, seventh connecting rod, eighth connecting rod and weight-bearing unit. The folding chair can be folded up like an umbrella and thus takes up little space and is portable and can be unfolded to demonstrate high stability and high load-bearing capability.

15 Claims, 5 Drawing Sheets

FOLDING CHAIR

CROSS-REFERENCE TO RELATED APPLICATION

This non-provisional application claims priority under 35 U.S.C. § 119(a) on Patent Application No(s). 202110401266.7 filed in China on Apr. 14, 2021, the entire contents of which are hereby incorporated by reference.

BACKGROUND OF THE INVENTION

1. Field of the Invention

The present disclosure relates to folding chairs, and in particular to a folding chair foldable to store and unfoldable to use.

2. Description of the Related Art

A conventional folding chair consists of a frame, two legs, a pad and a back rest. The legs movably cross the frame to fit thereto. The pad is movably fitted to the frame. The back rest is fitted to the top of the frame. Therefore, the legs and the pad are unfolded on one side of the frame such that a sitter can sit on the pad. Alternatively, the legs and the pad can press against each other toward the frame, thereby allowing the folding chair to be folded.

However, the conventional folding chair has drawbacks described below. Folding the conventional folding chair involves pressing the legs and the pad against each other toward the frame; as a result, the width of the frame and the width of the pad remain unchanged, regardless of whether the conventional folding chair is folded or unfolded, and thus the conventional folding chair takes up much space and is not portable. Furthermore, after the folding chair has been unfolded, only the bottom of the frame and the legs are in contact with the ground to bear the weight of the folding chair, thereby compromising the stability and load-bearing capability of the folding chair.

BRIEF SUMMARY OF THE INVENTION

At least one embodiment of the present disclosure provides a folding chair which can be folded up like an umbrella and thus takes up little space and is portable and can be unfolded to demonstrate high stability and high load-bearing capability.

To achieve at least the above objective, the present disclosure provides a folding chair comprising a left central support rod, left front support rod, left rear support rod, left central leg terminal, left front leg terminal, left rear leg terminal, left limiting element, left sliding element, left limiting sliding element, left connecting element, right central support rod, right front support rod, right rear support rod, right central leg terminal, right front leg terminal, right rear leg terminal, right limiting element, right sliding element, right limiting sliding element, right connecting element, first connecting rod, second connecting rod, third connecting rod, fourth connecting rod, fifth connecting rod, sixth connecting rod, seventh connecting rod, eighth connecting rod and weight-bearing unit. One end of the left central support rod is disposed at the left central leg terminal. The left limiting element, the left sliding element and the left limiting sliding element are disposed at the left central support rod. The left limiting element is disposed below the left sliding element. The left sliding element is disposed below the left limiting sliding element. The left connecting element is disposed at the other end of the left central support rod. One end of the left front support rod is disposed at the left front leg terminal. The other end of the left front support rod is pivotally disposed at the left connecting element. One end of the left rear support rod is disposed at the left rear leg terminal. The other end of the left rear support rod is pivotally disposed at the left connecting element. One end of the right central support rod is disposed at the right central leg terminal. The right limiting element, the right sliding element and the right limiting sliding element are disposed at the right central support rod. The right limiting element is disposed below the right sliding element. The right sliding element is disposed below the right limiting sliding element. The right connecting element is disposed at the other end of the right central support rod. One end of the right front support rod is disposed at the right front leg terminal. The other end of the right front support rod is pivotally disposed at the right connecting element. One end of the right rear support rod is disposed at the right rear leg terminal. The other end of the right rear support rod is pivotally disposed at the right connecting element. One end of the first connecting rod is pivotally disposed at the left central leg terminal. The other end of the first connecting rod is pivotally disposed at the right limiting sliding element. One end of the second connecting rod is pivotally disposed at the right central leg terminal. The other end of the second connecting rod is pivotally disposed at the left limiting sliding element. One end of the third connecting rod is pivotally disposed at the left front leg terminal. The other end of the third connecting rod is pivotally disposed at the left sliding element. One end of the fourth connecting rod is pivotally disposed at the left sliding element. The other end of the fourth connecting rod is pivotally disposed between two ends of the first connecting rod and positioned proximate to the left central leg terminal. One end of the fifth connecting rod is pivotally disposed at the left sliding element. The other end of the fifth connecting rod is pivotally disposed at the left rear leg terminal. One end of the sixth connecting rod is pivotally disposed at the right front leg terminal. The other end of the sixth connecting rod is pivotally disposed at the right sliding element. One end of the seventh connecting rod is pivotally disposed at the right sliding element. The other end of the seventh connecting rod is pivotally disposed between two ends of the second connecting rod and positioned proximate to the right central leg terminal. One end of the eighth connecting rod is pivotally disposed at the right sliding element. The other end of the eighth connecting rod is pivotally disposed at the right rear leg terminal. The weight-bearing unit comprises a seat cushion portion, back rest portion, left hanging portion and right hanging portion. The back rest portion and the seat cushion portion are connected. The left hanging portion and the right hanging portion flank the seat cushion portion. The left hanging portion and the right hanging portion are fitted to the left connecting element and the right connecting element, respectively.

Optionally, the left central leg terminal comprises a first coupling portion and a first pivotal connection portion. One end of the left central support rod is disposed at the first coupling portion. One end of the first connecting rod is pivotally disposed at the first pivotal connection portion.

Optionally, the left front leg terminal comprises a second coupling portion and a second pivotal connection portion. One end of the left front support rod is disposed at the second coupling portion. One end of the third connecting rod is pivotally disposed at the second pivotal connection portion.

Optionally, the left rear leg terminal comprises a third coupling portion and a third pivotal connection portion. One end of the left rear support rod is disposed at the third coupling portion. The other end of the fifth connecting rod is pivotally disposed at the third pivotal connection portion.

Optionally, the left sliding element comprises a first sliding close-fitting portion, fourth pivotal connection portion, fifth pivotal connection portion and sixth pivotal connection portion. The left central support rod is penetratingly disposed at the first sliding close-fitting portion. The other end of the third connecting rod is pivotally disposed at the fourth pivotal connection portion. One end of the fourth connecting rod is pivotally disposed at the fifth pivotal connection portion. One end of the fifth connecting rod is pivotally disposed at the sixth pivotal connection portion.

Optionally, the left limiting sliding element comprises a second sliding close-fitting portion, seventh pivotal connection portion and first engaging portion. The left central support rod is penetratingly disposed at the second sliding close-fitting portion. The other end of the second connecting rod is pivotally disposed at the seventh pivotal connection portion. The first engaging portion is engaged with or disengaged from the left central support rod.

Optionally, the first engaging portion has a first base, first pin, first resilient component and first pulling element. The first base is disposed at one edge of the second sliding close-fitting portion. The first pin is disposed at the first base. The first resilient component is disposed between the first base and the first pin. The first pulling element is disposed at the first pin. The left central support rod has a first limiting hole. The first pin is engaged with or disengaged from the first limiting hole of the left central support rod.

Optionally, the left connecting element comprises a fourth coupling portion, eighth pivotal connection portion, ninth pivotal connection portion and first rest portion. The other end of the left central support rod is disposed at the fourth coupling portion. The other end of the left front support rod is pivotally disposed at the eighth pivotal connection portion. The other end of the left rear support rod is pivotally disposed at the ninth pivotal connection portion. The left hanging portion is disposed at the first rest portion.

Optionally, the right central leg terminal comprises a fifth coupling portion and tenth pivotal connection portion. One end of the right central support rod is disposed at the fifth coupling portion. One end of the second connecting rod is pivotally disposed at the tenth pivotal connection portion.

Optionally, the right front leg terminal comprises a sixth coupling portion and eleventh pivotal connection portion. One end of the right front support rod is disposed at the sixth coupling portion. One end of the sixth connecting rod is pivotally disposed at the eleventh pivotal connection portion.

Optionally, the right rear leg terminal comprises a seventh coupling portion and twelfth pivotal connection portion. One end of the right rear support rod is disposed at the seventh coupling portion. The other end of the eighth connecting rod is pivotally disposed at the twelfth pivotal connection portion.

Optionally, the right sliding element comprises a third sliding close-fitting portion, thirteenth pivotal connection portion, fourteenth pivotal connection portion and fifteenth pivotal connection portion. The right central support rod is penetratingly disposed at the third sliding close-fitting portion. The other end of the sixth connecting rod is pivotally disposed at the thirteenth pivotal connection portion. One end of the seventh connecting rod is pivotally disposed at the fourteenth pivotal connection portion. One end of the eighth connecting rod is pivotally disposed at the fifteenth pivotal connection portion.

Optionally, the right limiting sliding element comprises a fourth sliding close-fitting portion, sixteenth pivotal connection portion and second engaging portion. The right central support rod is penetratingly disposed at the fourth sliding close-fitting portion. The other end of the first connecting rod is pivotally disposed at the sixteenth pivotal connection portion. The second engaging portion is engaged with or disengaged from the right central support rod.

Optionally, the second engaging portion has a second base, second pin, second resilient component and second pulling element. The second base is disposed at an edge of the fourth sliding close-fitting portion. The second pin is disposed at the second base. The second resilient component is disposed between the second base and the second pin. The second pulling element is disposed at the second pin. The right central support rod has a second limiting hole. The second pin is engaged with or disengaged from the second limiting hole of the right central support rod.

Optionally, the right connecting element comprises an eighth coupling portion, seventeenth pivotal connection portion, eighteenth pivotal connection portion and second rest portion. The right central support rod has another end disposed at the eighth coupling portion. The right front support rod has another end pivotally disposed at the seventeenth pivotal connection portion. The right rear support rod has another end pivotally disposed at the eighteenth pivotal connection portion. The right hanging portion is disposed at the second rest portion.

DETAILED DESCRIPTION OF THE INVENTION

Figure 1:
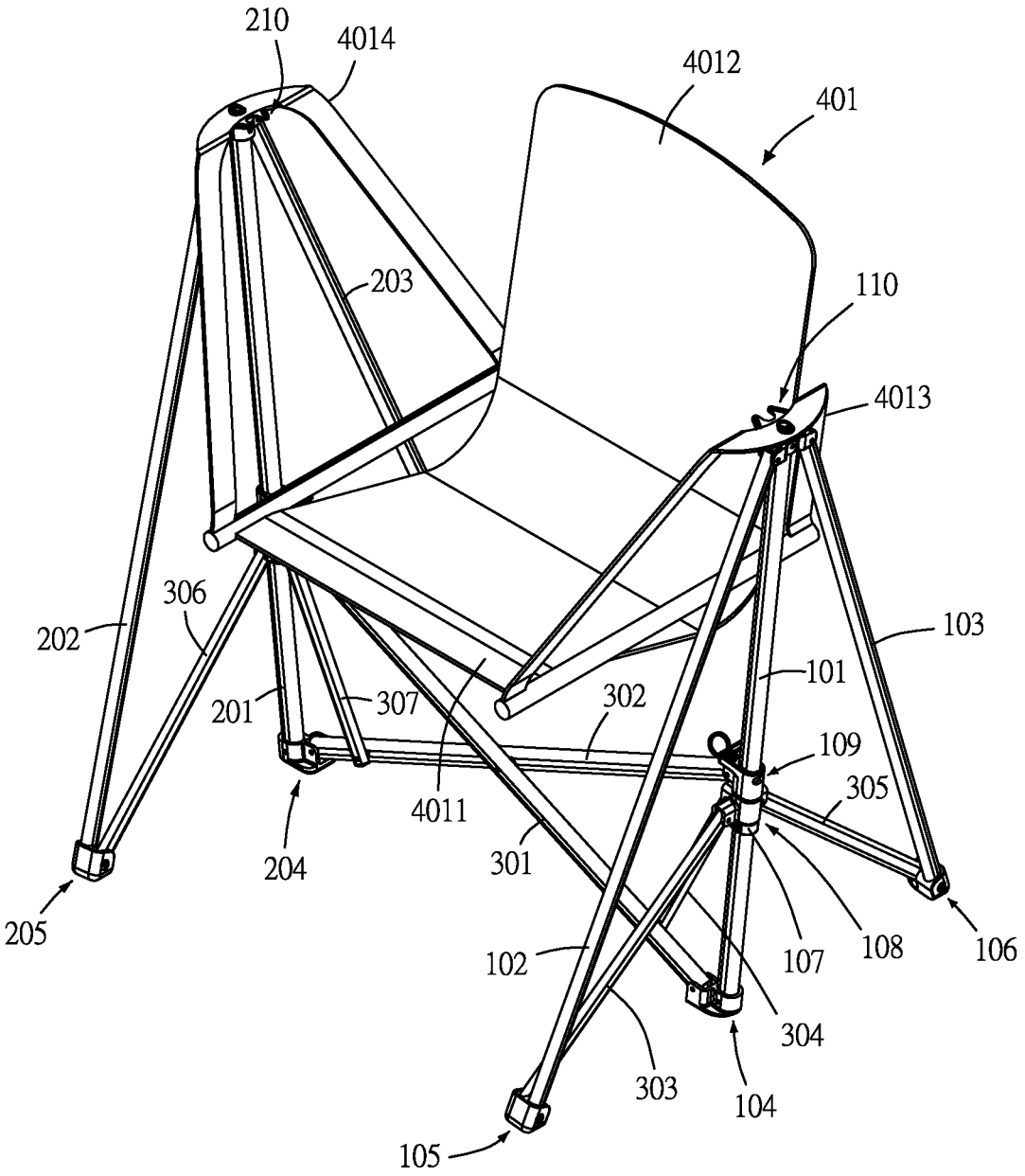
FIG. 1 is a schematic view of a folding chair unfolded according to the present disclosure.

To facilitate understanding of the object, characteristics and effects of this present disclosure, embodiments together with the attached drawings for the detailed description of the present disclosure are provided.

A folding chair in an embodiment of the present disclosure is depicted with accompanying drawings and described below.

Referring to FIG. 1 through FIG. 5, the present disclosure provides a folding chair which comprises a left central support rod 101, left front support rod 102, left rear support rod 103, left central leg terminal 104, left front leg terminal 105, left rear leg terminal 106, left limiting element 107, left sliding element 108, left limiting sliding element 109, left connecting element 110, right central support rod 201, right front support rod 202, right rear support rod 203, right central leg terminal 204, right front leg terminal 205, right rear leg terminal 206, right limiting element 207, right sliding element 208, right limiting sliding element 209, right connecting element 210, first connecting rod 301, second connecting rod 302, third connecting rod 303, fourth connecting rod 304, fifth connecting rod 305, sixth connecting rod 306, seventh connecting rod 307, eighth connecting rod 308 and weight-bearing unit 401.

One end of the left central support rod 101 is disposed at the left central leg terminal 104. The left limiting element 107, the left sliding element 108 and the left limiting sliding element 109 are disposed at the left central support rod 101. The left limiting element 107 is disposed below the left sliding element 108. The left sliding element 108 is disposed below the left limiting sliding element 109. The left connecting element 110 is disposed at the other end of the left central support rod 101. One end of the left front support rod 102 is disposed at the left front leg terminal 105. The other end of the left front support rod 102 is pivotally disposed at the left connecting element 110. One end of the left rear support rod 103 is disposed at the left rear leg terminal 106. The other end of the left rear support rod 103 is pivotally disposed at the left connecting element 110.

One end of the right central support rod 201 is disposed at the right central leg terminal 204. The right limiting element 207, the right sliding element 208 and the right limiting sliding element 209 are disposed at the right central support rod 201. The right limiting element 207 is disposed below the right sliding element 208. The right sliding element 208 is disposed below the right limiting sliding element 209. The right connecting element 210 is disposed at the other end of the right central support rod 201. One end of the right front support rod 202 is disposed at the right front leg terminal 205. The other end of the right front support rod 202 is pivotally disposed at the right connecting element 210. One end of the right rear support rod 203 is disposed at the right rear leg terminal 206. The other end of the right rear support rod 203 is pivotally disposed at the right connecting element 210.

One end of the first connecting rod 301 is pivotally disposed at the left central leg terminal 104. The other end of the first connecting rod 301 is pivotally disposed at the right limiting sliding element 209.

One end of the second connecting rod 302 is pivotally disposed at the right central leg terminal 204. The other end of the second connecting rod 302 is pivotally disposed at the left limiting sliding element 109.

One end of the third connecting rod 303 is pivotally disposed at the left front leg terminal 105. The other end of the third connecting rod 303 is pivotally disposed at the left sliding element 108.

One end of the fourth connecting rod 304 is pivotally disposed at the left sliding element 108. The other end of the fourth connecting rod 304 is pivotally disposed between two ends of the first connecting rod 301 and positioned proximate to the left central leg terminal 104.

One end of the fifth connecting rod 305 is pivotally disposed at the left sliding element 108. The other end of the fifth connecting rod 305 is pivotally disposed at the left rear leg terminal 106.

One end of the sixth connecting rod 306 is pivotally disposed at the right front leg terminal 205. The other end of the sixth connecting rod 306 is pivotally disposed at the right sliding element 208.

One end of the seventh connecting rod 307 is pivotally disposed at the right sliding element 208. The other end of the seventh connecting rod 307 is pivotally disposed between the second connecting rod 302 and positioned proximate to the right central leg terminal 204.

One end of the eighth connecting rod 308 is pivotally disposed at the right sliding element 208. The other end of the eighth connecting rod 208 is pivotally disposed at the right rear leg terminal 206.

The weight-bearing unit 401 comprises a seat cushion portion 4011, back rest portion 4012, left hanging portion 4013 and right hanging portion 4014. The back rest portion 4012 and the seat cushion portion 4011 are connected. The left hanging portion 4013 and the right hanging portion 4014 flank the seat cushion portion 4011. The left hanging portion 4013 and the right hanging portion 4014 are fitted to the left connecting element 110 and the right connecting element 201, respectively.

Figure 2:
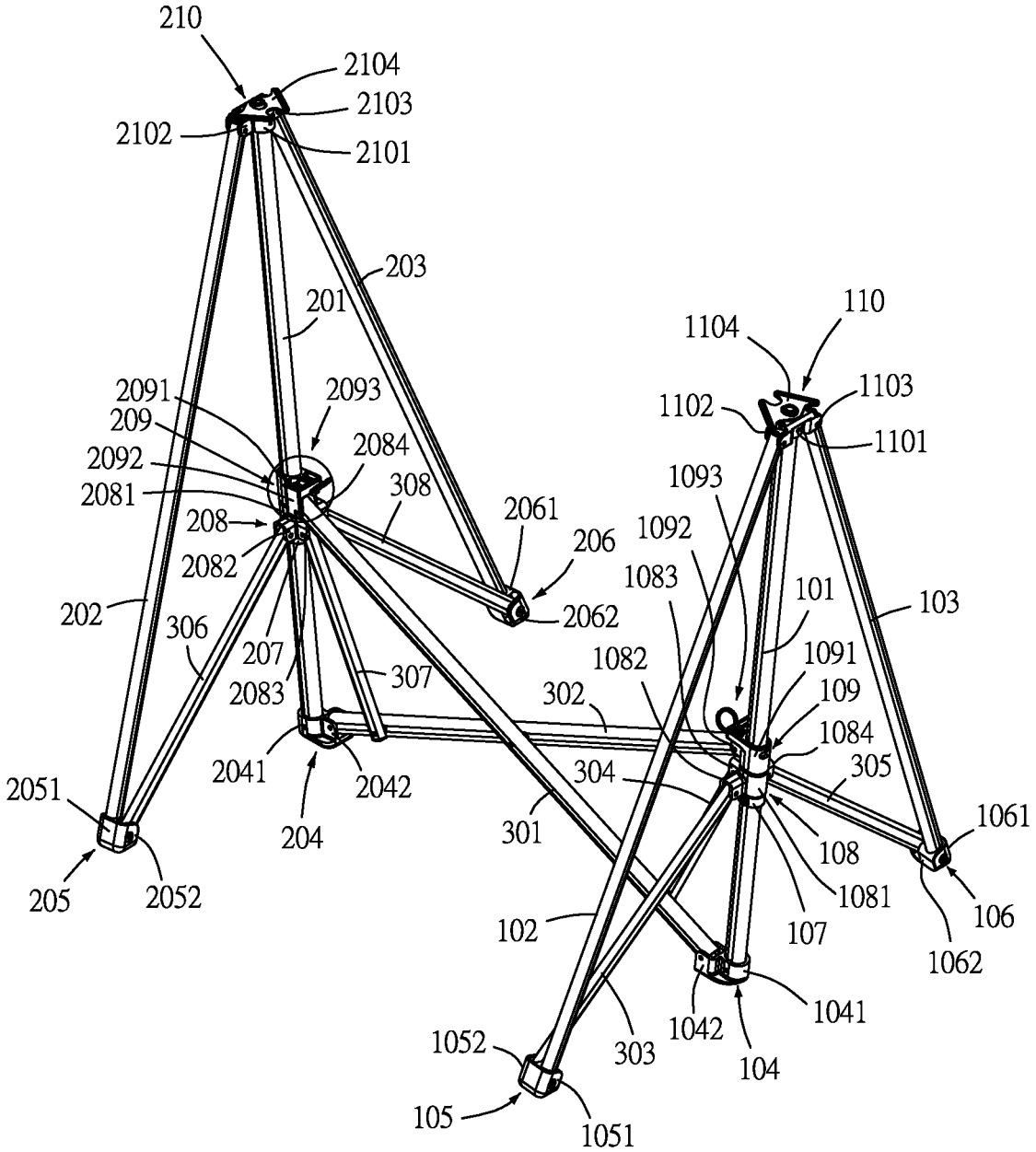
FIG. 2 is a schematic view of the folding chair unfolded according to the present disclosure, not showing a seat cushion portion and a back rest portion.
Figure 4:
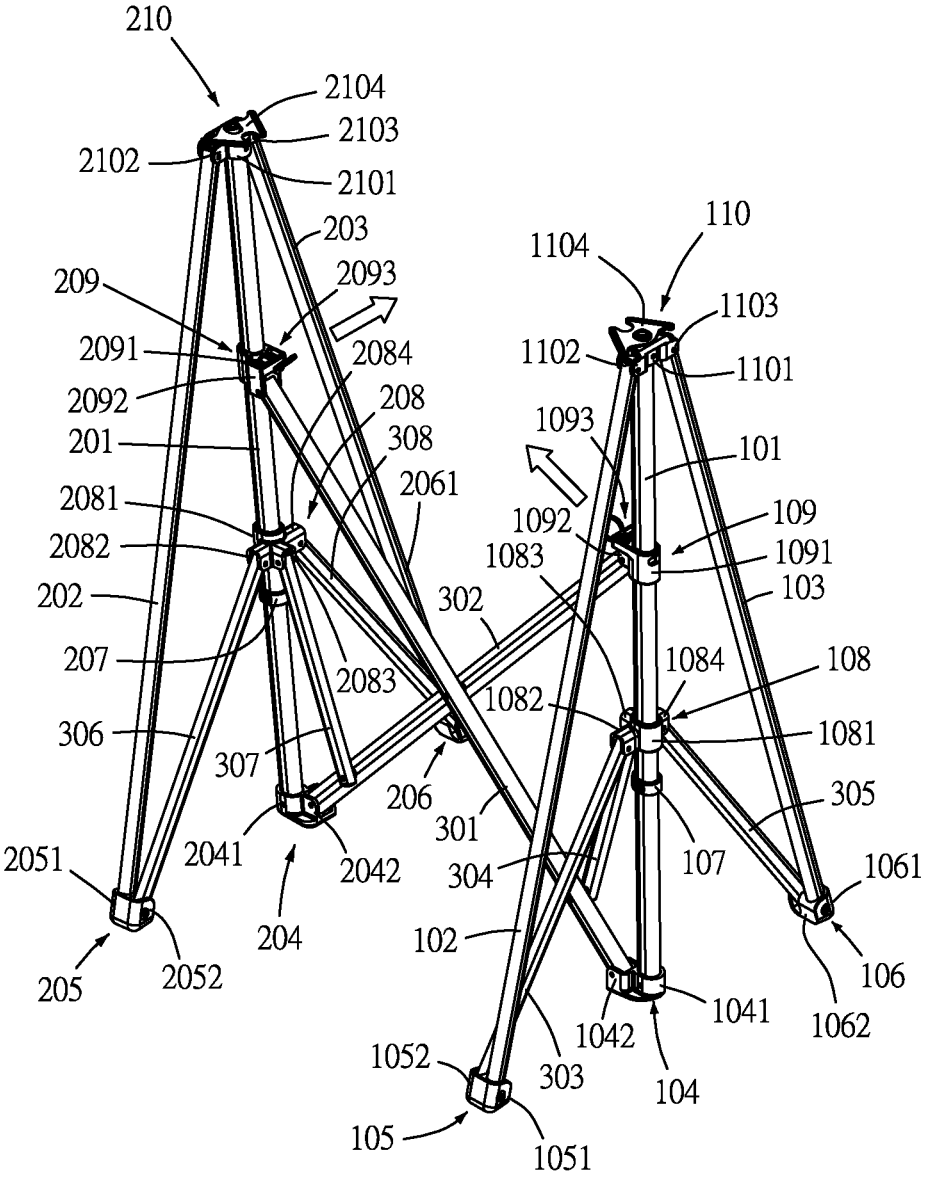
FIG. 4 is a schematic view of the folding chair folded according to the present disclosure, not showing a seat cushion portion and a back rest portion.
Figure 5:
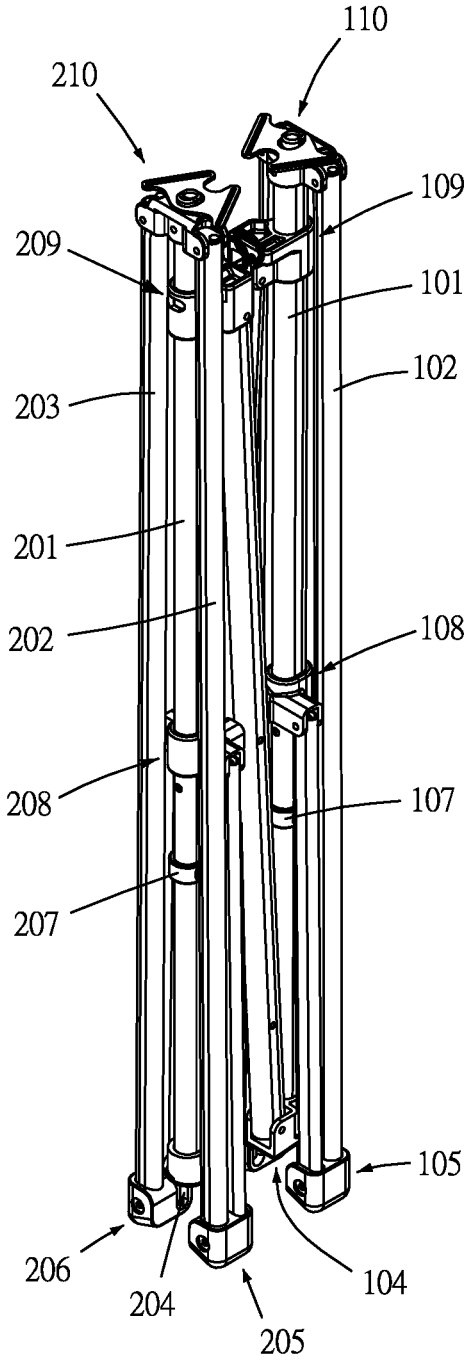
FIG. 5 is another schematic view of the folding chair folded according to the present disclosure, not showing a seat cushion portion and a back rest portion.

Referring to FIG. 2, FIG. 4 and FIG. 5, to fold up the folding chair of the present disclosure, users remove the weight-bearing unit 401, disengage the left limiting sliding element 109 from the right limiting sliding element 209 before moving it upward, such that the left limiting sliding element 109 moves the second connecting rod 302, allowing the second connecting rod 302 to pull the right central leg terminal 204, moving the right central support rod 201 toward the left central support rod 101, allowing the seventh connecting rod 307 to move the right sliding element 208 upward, allowing the right sliding element 208 to move the sixth connecting rod 306 and the eighth connecting rod 308, allowing the sixth connecting rod 306 to pull the right front leg terminal 205 and the right front support rod 202 toward the right central support rod 201, allowing the eighth connecting rod 308 to pull the right rear leg terminal 206 and the right rear support rod 203 toward the right central support rod 201, thereby allowing the right front support rod 202, the right rear support rod 203, the first connecting rod 301, the sixth connecting rod 306, the seventh connecting rod 307 and the eighth connecting rod 308 to press against each other toward the right central support rod 201 (as shown in FIG. 2 and FIG. 4).

While carrying out the aforesaid steps, the users may not only use the right limiting sliding element 209 to move the first connecting rod 301, allowing the first connecting rod 301 to pull the left central leg terminal 104, thereby moving the left central support rod 101 toward the right central support rod 201, but also use the fourth connecting rod 304 to push the left sliding element 108 upward, allowing the left sliding element 108 to move the third connecting rod 303 and the fifth connecting rod 305, allowing the third connecting rod 303 to pull the left front leg terminal 105 and the left front support rod 102 toward the left central support rod 101, allowing the fifth connecting rod 305 to pull the left rear leg terminal 106 and the left rear support rod 103 toward the left central support rod 101, thereby allowing the left front support rod 102, the left rear support rod 103, the second connecting rod 302, the third connecting rod 303, the fourth connecting rod 304 and the fifth connecting rod 305 to press against each other toward the left central support rod 101 (as shown in FIG. 2 and FIG. 4). Therefore, the folding chair of the present disclosure can be folded up like an umbrella (as shown in FIG. 5) and thus takes up little space and is portable.

Unfolding the folding chair of the present disclosure entails manipulating the left central support rod 101, the left front support rod 102, the left rear support rod 103, the left central leg terminal 104, the left front leg terminal 105, the left rear leg terminal 106, the left limiting element 107, the left sliding element 108, the left limiting sliding element 109, the left connecting element 110, the right central support rod 201, the right front support rod 202, the right rear support rod 203, the right central leg terminal 204, the right front leg terminal 205, the right rear leg terminal 206, the right limiting element 207, the right sliding element 208, the right limiting sliding element 209, the right connecting element 210, the first connecting rod 301, the second connecting rod 302, the third connecting rod 303, the fourth connecting rod 304, the fifth connecting rod 305, the sixth connecting rod 306, the seventh connecting rod 307 and the eighth connecting rod 308 to demonstrate high stability and high load-bearing capability (as shown in FIG. 2).

Unfolding the folding chair of the present disclosure causes the left sliding element 108 to press against the left limiting element 107, the left limiting sliding element 109 to press against the left sliding element 108, the right sliding element 208 to press against the right limiting element 207, and the right limiting sliding element 209 to press against the right sliding element 208. Thus, the folding chair of the present disclosure can be unfolded to demonstrate high stability and high load-bearing capability (as shown in FIG. 2).

In an embodiment illustrated by FIG. 2 and FIG. 4, the left central leg terminal 104 comprises a first coupling portion 1041 and a first pivotal connection portion 1042. One end of the left central support rod 101 is disposed at the first coupling portion 1041. One end of the first connecting rod 301 is pivotally disposed at the first pivotal connection portion 1042. Therefore, for the folding chair of the present disclosure to be folded or unfolded, it is feasible for the left central support rod 101, the left central leg terminal 104 and the first connecting rod 301 to move together so as to not only attain smooth rotation but also enable the folding chair of the present disclosure to be unfolded to demonstrate high stability and high load-bearing capability.

In an embodiment illustrated by FIG. 2 and FIG. 4, the left front leg terminal 105 comprises a second coupling portion 1051 and a second pivotal connection portion 1052. One end of the left front support rod 102 is disposed at the second coupling portion 1051. One end of the third connecting rod 303 is pivotally disposed at the second pivotal connection portion 1052. Therefore, for the folding chair of the present disclosure to be folded or unfolded, it is feasible for the left front support rod 102, the left front leg terminal 105 and the third connecting rod 303 to move together so as to not only attain smooth rotation but also enable the folding chair of the present disclosure to be unfolded to demonstrate high stability and high load-bearing capability.

In an embodiment illustrated by FIG. 2 and FIG. 4, the left rear leg terminal 106 comprises a third coupling portion 1061 and a third pivotal connection portion 1062. One end of the left rear support rod 103 is disposed at the third coupling portion 1061. The other end of the fifth connecting rod 305 is pivotally disposed at the third pivotal connection portion 1062. Therefore, for the folding chair of the present disclosure to be folded or unfolded, it is feasible for the left rear support rod 103, the left rear leg terminal 106 and the fifth connecting rod 305 to move together so as to not only attain smooth rotation but also enable the folding chair of the present disclosure to be unfolded to demonstrate high stability and high load-bearing capability.

In an embodiment illustrated by FIG. 2 and FIG. 4, the left sliding element 108 comprises a first sliding close-fitting portion 1081, fourth pivotal connection portion 1082, fifth pivotal connection portion 1083 and sixth pivotal connection portion 1084. The left central support rod 101 is penetratingly disposed at the first sliding close-fitting portion 1081. The other end of the third connecting rod 303 is pivotally disposed at the fourth pivotal connection portion 1082. One end of the fourth connecting rod 304 is pivotally disposed at the fifth pivotal connection portion 1083. One end of the fifth connecting rod 305 is pivotally disposed at the sixth pivotal connection portion 1084. Therefore, for the folding chair of the present disclosure to be folded or unfolded, it is feasible for the left central support rod 101, the left sliding element 108, the third connecting rod 303, the fourth connecting rod 304 and the fifth connecting rod 305 to move together so as to not only attain smooth rotation but also enable the folding chair of the present disclosure to be unfolded to demonstrate high stability and high load-bearing capability.

Figure 3:
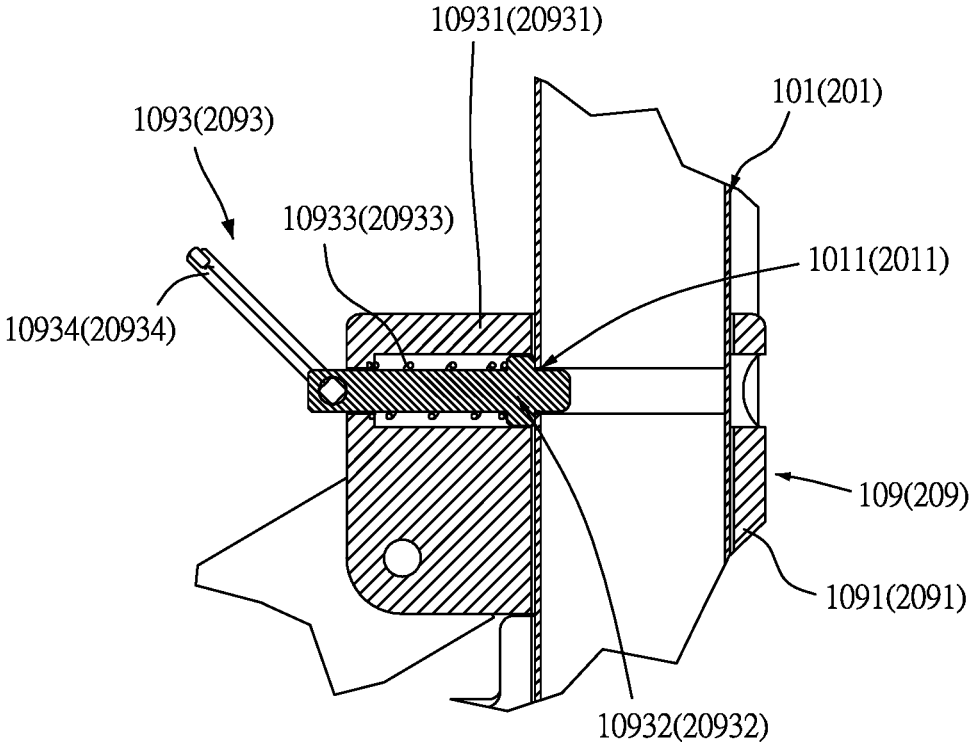
FIG. 3 is a cross-sectional view of a left limiting sliding element (a right limiting sliding element) of the folding chair of the present disclosure (the left limiting sliding element has the same cross-sectional structure as the right limiting sliding element, and thus the cross-sectional structure of both the left limiting sliding element and the right limiting sliding element are shown in FIG. 3).

In an embodiment illustrated by FIG. 2 through FIG. 4, the left limiting sliding element 109 comprises a second sliding close-fitting portion 1091, seventh pivotal connection portion 1092 and first engaging portion 1093. The left central support rod 101 is penetratingly disposed at the second sliding close-fitting portion 1091. The other end of the second connecting rod 302 is pivotally disposed at the seventh pivotal connection portion 1092. The first engaging portion 1093 is engaged with or penetratingly disposed at the left central support rod 101. Therefore, for the folding chair of the present disclosure to be folded or unfolded, it is feasible for the left central support rod 101, the left limiting sliding element 109 and the second connecting rod 302 to move together so as to not only attain smooth rotation but also enable the folding chair of the present disclosure to be unfolded to demonstrate high stability and high load-bearing capability.

With the first engaging portion 1093 being engaged with the left central support rod 101, the folding chair of the present disclosure can be unfolded to demonstrate high stability and high load-bearing capability. By contrast, folding up the folding chair of the present disclosure entails penetratingly positioning the first engaging portion 1093 of the left limiting sliding element 109 at the left central support rod 101 to move the left limiting sliding element 109 upward and thus fold up the folding chair of the present disclosure, so as to not only attain smooth rotation but also enable the folding chair of the present disclosure to be unfolded to demonstrate high stability and high load-bearing capability.

In an embodiment illustrated by FIG. 2 through FIG. 4, the first engaging portion 1093 has a first base 10931, first pin 10932, first resilient component 10933 and first pulling element 10934. The first base 10931 is disposed beside the second sliding close-fitting portion 1091. The first pin 10932 is disposed at the first base 10931. The first resilient component 10933 is disposed between the first base 10931 and the first pin 10932. The first pulling element 10934 is disposed at the first pin 10932. The left central support rod 101 has a first limiting hole 1011. The first pin 10932 is engaged with or penetratingly disposed at the first limiting hole 1011 of the left central support rod 101. Therefore, the first resilient component 10933 of the first engaging portion 1093 pushes the first pin 10932, such that the first pin 10932 gets engaged with the first limiting hole 1011 of the left central support rod 101, thereby allowing the folding chair of the present disclosure to be unfolded to demonstrate high stability and high load-bearing capability. To fold up the folding chair of the present disclosure, the users exert a force on the first pulling element 10934, such that the first pin 10932 exits the first limiting hole 1011 and compresses the first resilient component 10933, allowing the first engaging portion 1093 of the left limiting sliding element 109 to be penetratingly disposed on the left central support rod 101, moving the left limiting sliding element 109 upward, thereby allowing the folding chair of the present disclosure to be folded up so as to not only attain smooth rotation but also enable the folding chair of the present disclosure to be unfolded to demonstrate high stability and high load-bearing capability.

In an embodiment illustrated by FIG. 1, FIG. 2 and FIG. 4, the left connecting element 110 comprises a fourth coupling portion 1101, eighth pivotal connection portion 1102, ninth pivotal connection portion 1103 and first rest portion 1104. The other end of the left central support rod 101 is disposed at the fourth coupling portion 1101. The other end of the left front support rod 102 is pivotally disposed at the eighth pivotal connection portion 1102. The other end of the left rear support rod 103 is pivotally disposed at the ninth pivotal connection portion 1103. The left hanging portion 4013 is disposed at the first rest portion 1104. Therefore, for the folding chair of the present disclosure to be folded or unfolded, it is feasible for the left central support rod 101, the left front support rod 102, the left rear support rod 103 and the left connecting element 110 to move together so as to not only attain smooth rotation but also enable the folding chair of the present disclosure to be unfolded to demonstrate high stability and high load-bearing capability. After the folding chair of the present disclosure has been unfolded, the left hanging portion 4013 of the weight-bearing unit 401 is fitted to the left connecting element 110 to augment stability.

In an embodiment illustrated by FIG. 2 and FIG. 4, the right central leg terminal 204 comprises a fifth coupling portion 2041 and a tenth pivotal connection portion 2042. One end of the right central support rod 201 disposed at the fifth coupling portion 2041. One end of the second connecting rod 302 is pivotally disposed at the tenth pivotal connection portion 2042. Therefore, for the folding chair of the present disclosure to be folded or unfolded, it is feasible for the right central support rod 201, the right central leg terminal 204 and the second connecting rod 302 to move together so as to not only attain smooth rotation but also enable the folding chair of the present disclosure to be unfolded to demonstrate high stability and high load-bearing capability.

In an embodiment illustrated by FIG. 2 and FIG. 4, the right front leg terminal 205 comprises a sixth coupling portion 2051 and an eleventh pivotal connection portion 2052. One end of the right front support rod 202 disposed at the sixth coupling portion 2051. One end of the sixth connecting rod 306 is pivotally disposed at the eleventh pivotal connection portion 2052. Therefore, for the folding chair of the present disclosure to be folded or unfolded, it is feasible for the right front support rod 202, the right front leg terminal 205 and the sixth connecting rod 306 to move together so as to not only attain smooth rotation but also enable the folding chair of the present disclosure to be unfolded to demonstrate high stability and high load-bearing capability.

In an embodiment illustrated by FIG. 2 and FIG. 4, the right rear leg terminal 206 comprises a seventh coupling portion 2061 and a twelfth pivotal connection portion 2062. One end of the right rear support rod 203 is disposed at the seventh coupling portion 2061. The other end of the eighth connecting rod 308 is pivotally disposed at the twelfth pivotal connection portion 2062. Therefore, for the folding chair of the present disclosure to be folded or unfolded, it is feasible for the right rear support rod 203, the right rear leg terminal 206 and the eighth connecting rod 308 to move together so as to not only attain smooth rotation but also enable the folding chair of the present disclosure to be unfolded to demonstrate high stability and high load-bearing capability.

In an embodiment illustrated by FIG. 2 and FIG. 4, the right sliding element 208 comprises a third sliding close-fitting portion 2081, thirteenth pivotal connection portion 2082, fourteenth pivotal connection portion 2083 and fifteenth pivotal connection portion 2084. The right central support rod 201 is penetratingly disposed at the third sliding close-fitting portion 2081, and the other end of the sixth connecting rod 306 is pivotally disposed at the thirteenth pivotal connection portion 2082. One end of the seventh connecting rod 307 is pivotally disposed at the fourteenth pivotal connection portion 2083. One end of the eighth connecting rod 308 is pivotally disposed at the fifteenth pivotal connection portion 2084. Therefore, for the folding chair of the present disclosure to be folded or unfolded, it is feasible for the right central support rod 201, the right sliding element 208, the sixth connecting rod 306, the seventh connecting rod 307 and the eighth connecting rod 308 to move together so as to not only attain smooth rotation but also enable the folding chair of the present disclosure to be unfolded to demonstrate high stability and high load-bearing capability.

In an embodiment illustrated by FIG. 2 through FIG. 4, the right limiting sliding element 209 comprises a fourth sliding close-fitting portion 2091, sixteenth pivotal connection portion 2092 and second engaging portion 2093. The right central support rod 201 is penetratingly disposed at the fourth sliding close-fitting portion 2091. The other end of the first connecting rod 301 is pivotally disposed at the sixteenth pivotal connection portion 2092. The second engaging portion 2093 is engaged with or penetratingly disposed at the right central support rod 201. Therefore, for the folding chair of the present disclosure to be folded or unfolded, it is feasible for the right central support rod 201, the right limiting sliding element 209 and the first connecting rod 301 to move together so as to not only attain smooth rotation but also enable the folding chair of the present disclosure to be unfolded to demonstrate high stability and high load-bearing capability.

With the second engaging portion 2093 being engaged with the right central support rod 201, the folding chair of the present disclosure can be unfolded to demonstrate high stability and high load-bearing capability. Folding up the folding chair of the present disclosure entails penetratingly positioning the second engaging portion 2093 of the right limiting sliding element 209 at the right central support rod 201 to allow the right limiting sliding element 209 to move upward, thereby allowing the folding chair of the present disclosure to be folded up, so as to not only attain smooth rotation but also enable the folding chair of the present disclosure to be unfolded to demonstrate high stability and high load-bearing capability.

In an embodiment illustrated by FIG. 2 through FIG. 4, the second engaging portion 2093 has a second base 20931, second pin 20932, second resilient component 20933 and second pulling element 20934. The second base 20931 is disposed beside the fourth sliding close-fitting portion 2091. The second pin 20932 is disposed at the second base 20931.

The second resilient component 20933 is disposed between the second base 20931 and the second pin 20932. The second pulling element 20934 is disposed at the second pin 20932. The right central support rod 201 has a second limiting hole 2011. The second pin 20932 is engaged with or penetratingly disposed at the second limiting hole 2011 of the right central support rod 201. Therefore, the second resilient component 20933 of the second engaging portion 2093 pushes the second pin 20932, such that the second pin 20932 gets engaged with the second limiting hole 2011 of the right central support rod 201, allowing the folding chair of the present disclosure to be unfolded to demonstrate high stability and high load-bearing capability. To fold up the folding chair of the present disclosure, the users exert a force on the second pulling element 20934, such that the second pin 20932 exits the second limiting hole 2011 and compresses the second resilient component 20933, allowing the second engaging portion 2093 of the right limiting sliding element 209 to be penetratingly disposed on the right central support rod 201, moving the right limiting sliding element 209 upward, thereby allowing the folding chair of the present disclosure to be folded up, so as to not only attain smooth rotation but also enable the folding chair of the present disclosure to be unfolded to demonstrate high stability and high load-bearing capability.

In an embodiment illustrated by FIG. 1, FIG. 2 and FIG. 4, the right connecting element 210 comprises an eighth coupling portion 2101, seventeenth pivotal connection portion 2102, eighteenth pivotal connection portion 2103 and second rest portion 2104. The other end of the right central support rod 201 is disposed at the eighth coupling portion 2101, and the other end of the right front support rod 202 is pivotally disposed at the seventeenth pivotal connection portion 2102. The other end of the right rear support rod 203 is pivotally disposed at the eighteenth pivotal connection portion 2103. The right hanging portion 4014 rests on the second rest portion 2104. Therefore, for the folding chair of the present disclosure to be folded or unfolded, it is feasible for the right central support rod 201, the right front support rod 202, the right rear support rod 203 and the right connecting element 210 to move together so as to not only attain smooth rotation but also enable the folding chair of the present disclosure to be unfolded to demonstrate high stability and high load-bearing capability. After the folding chair of the present disclosure has been unfolded, the right hanging portion 4014 of the weight-bearing unit 401 is fitted to the right connecting element 210 to augment stability.

Therefore, the folding chair provided in an embodiment of the present disclosure can be folded up like an umbrella and thus takes up little space and is portable and can be unfolded to demonstrate high stability and high load-bearing capability.

The abovementioned constitutes just an embodiment of the present disclosure but is not restrictive of the scope of the claims of the present disclosure.

While the present disclosure has been described by means of specific embodiments, numerous modifications and variations could be made thereto by those skilled in the art without departing from the scope and spirit of the present disclosure set forth in the claims.

What is claimed is:

1. A folding chair, comprising:

a left central support rod, left front support rod, left rear support rod, left central leg terminal, left front leg terminal, left rear leg terminal, left limiting element, left sliding element, left limiting sliding element, left connecting element, right central support rod, right front support rod, right rear support rod, right central leg terminal, right front leg terminal, right rear leg terminal, right limiting element, right sliding element, right limiting sliding element, right connecting element, first connecting rod, second connecting rod, third connecting rod, fourth connecting rod, fifth connecting rod, sixth connecting rod, seventh connecting rod, eighth connecting rod and weight-bearing unit;

wherein an end of the left central support rod is disposed at the left central leg terminal, wherein the left limiting element, the left sliding element and the left limiting sliding element are disposed at the left central support rod, wherein the left limiting element is disposed below the left sliding element, wherein the left sliding element is disposed below the left limiting sliding element, wherein the left connecting element is disposed at another end of the left central support rod, wherein one end of the left front support rod is disposed at the left front leg terminal, wherein another end of the left front support rod is pivotally disposed at the left connecting element, wherein one end of the left rear support rod is disposed at the left rear leg terminal, wherein another end of the left rear support rod is pivotally disposed at the left connecting element;

wherein one end of the right central support rod is disposed at the right central leg terminal, the right limiting element and the right sliding element, and the right limiting sliding element is disposed at the right central support rod, wherein the right limiting element is disposed below the right sliding element, wherein the right sliding element is disposed below the right limiting sliding element, wherein the right connecting element is disposed at another end of the right central support rod, wherein one end of the right front support rod is disposed at the right front leg terminal, wherein another end of the right front support rod is pivotally disposed at the right connecting element, wherein one end of the right rear support rod is disposed at the right rear leg terminal, wherein another end of the right rear support rod is pivotally disposed at the right connecting element;

wherein the first connecting rod has an end pivotally disposed at the left central leg terminal and another end pivotally disposed at the right limiting sliding element;

wherein the second connecting rod has an end pivotally disposed at the right central leg terminal and another end pivotally disposed at the left limiting sliding element;

wherein the third connecting rod has an end pivotally disposed at the left front leg terminal and another end pivotally disposed at the left sliding element;

wherein the fourth connecting rod has an end pivotally disposed at the left sliding element and another end pivotally disposed between two ends of the first connecting rod and positioned proximate to the left central leg terminal;

wherein the fifth connecting rod has an end pivotally disposed at the left sliding element and another end pivotally disposed at the left rear leg terminal;

wherein the sixth connecting rod has an end pivotally disposed at the right front leg terminal and another end pivotally disposed at the right sliding element;

wherein the seventh connecting rod has an end pivotally disposed at the right sliding element and another end pivotally disposed between two ends of the second connecting rod and positioned proximate to the right central leg terminal;

wherein the eighth connecting rod has an end pivotally disposed at the right sliding element and another end pivotally disposed at the right rear leg terminal;

wherein the weight-bearing unit comprises a seat cushion portion, back rest portion, left hanging portion and right hanging portion, with the back rest portion connected to the seat cushion portion, wherein the left hanging portion and the right hanging portion are disposed at two edges of the seat cushion portion, respectively, and fitted to the left connecting element and the right connecting element, respectively.

2. The folding chair of claim 1, wherein the left central leg terminal comprises a first coupling portion and a first pivotal connection portion, with the left central support rod having an end disposed at the first coupling portion, and the first connecting rod having an end pivotally disposed at the first pivotal connection portion.

3. The folding chair of claim 1, wherein the left front leg terminal comprises a second coupling portion and a second pivotal connection portion, wherein an end of the left front support rod is disposed at the second coupling portion, wherein an end of the third connecting rod is pivotally disposed at the second pivotal connection portion.

4. The folding chair of claim 1, wherein the left rear leg terminal comprises a third coupling portion and a third pivotal connection portion, wherein an end of the left rear support rod is disposed at the third coupling portion, wherein another end of the fifth connecting rod is pivotally disposed at the third pivotal connection portion.

5. The folding chair of claim 1, wherein the left sliding element comprises a first sliding close-fitting portion, fourth pivotal connection portion, fifth pivotal connection portion and sixth pivotal connection portion, wherein the left central support rod is penetratingly disposed at the first sliding close-fitting portion, wherein another end of the third connecting rod is pivotally disposed at the fourth pivotal connection portion, wherein an end of the fourth connecting rod is pivotally disposed at the fifth pivotal connection portion, wherein an end of the fifth connecting rod is pivotally disposed at the sixth pivotal connection portion.

6. The folding chair of claim 1, wherein the left limiting sliding element comprises a second sliding close-fitting portion, seventh pivotal connection portion and first engaging portion, wherein the left central support rod is penetratingly disposed at the second sliding close-fitting portion, wherein another end of the second connecting rod is pivotally disposed at the seventh pivotal connection portion, wherein the first engaging portion is engaged with or penetratingly disposed at the left central support rod.

7. The folding chair of claim 6, wherein the first engaging portion has a first base, first pin, first resilient component and first pulling element, the first base being disposed beside the second sliding close-fitting portion, the first pin being disposed at the first base, the first resilient component being disposed beside the first base and the first pin, the first pulling element being disposed at the first pin, wherein the left central support rod has a first limiting hole which the first pin is engaged with or penetratingly disposed at.

8. The folding chair of claim 1, wherein the left connecting element comprises a fourth coupling portion, eighth pivotal connection portion, ninth pivotal connection portion and first rest portion, wherein another end of the left central support rod is disposed at the fourth coupling portion, wherein another end of the left front support rod is pivotally disposed at the eighth pivotal connection portion, wherein another end of the left rear support rod is pivotally disposed at the ninth pivotal connection portion, wherein the left hanging portion is disposed at the first rest portion.

9. The folding chair of claim 1, wherein the right central leg terminal comprises a fifth coupling portion and a tenth pivotal connection portion, wherein an end of the right central support rod is disposed at the fifth coupling portion, wherein an end of the second connecting rod is pivotally disposed at the tenth pivotal connection portion.

10. The folding chair of claim 1, wherein the right front leg terminal comprises a sixth coupling portion and an eleventh pivotal connection portion, wherein an end of the right front support rod is disposed at the sixth coupling portion, wherein an end of the sixth connecting rod is pivotally disposed at the eleventh pivotal connection portion.

11. The folding chair of claim 1, wherein the right rear leg terminal comprises a seventh coupling portion and a twelfth pivotal connection portion, wherein an end of the right rear support rod is disposed at the seventh coupling portion, wherein another end of the eighth connecting rod is pivotally disposed at the twelfth pivotal connection portion.

12. The folding chair of claim 1, wherein the right sliding element comprises a third sliding close-fitting portion, thirteenth pivotal connection portion, fourteenth pivotal connection portion and fifteenth pivotal connection portion, wherein the right central support rod is penetratingly disposed at the third sliding close-fitting portion, wherein another end of the sixth connecting rod is pivotally disposed at the thirteenth pivotal connection portion, wherein an end of the seventh connecting rod is pivotally disposed at the fourteenth pivotal connection portion, wherein an end of the eighth connecting rod is pivotally disposed at the fifteenth pivotal connection portion.

13. The folding chair of claim 1, wherein the right limiting sliding element comprises a fourth sliding close-fitting portion, sixteenth pivotal connection portion and second engaging portion, wherein the right central support rod is penetratingly disposed at the fourth sliding close-fitting portion, wherein another end of the first connecting rod is pivotally disposed at the sixteenth pivotal connection portion, wherein the second engaging portion is engaged with or penetratingly disposed at the right central support rod.

14. The folding chair of claim 13, wherein the second engaging portion has a second base, second pin, second resilient component and second pulling element, the second base being disposed beside the fourth sliding close-fitting portion, the second pin being disposed at the second base, the second resilient component being disposed between the second base and the second pin, the second pulling element being disposed at the second pin, the right central support rod having a second limiting hole, and the second pin being engaged with or penetratingly disposed at the second limiting hole of the right central support rod.

15. The folding chair of claim 1, wherein the right connecting element comprises an eighth coupling portion, seventeenth pivotal connection portion, eighteenth pivotal connection portion and second rest portion, wherein another end of the right central support rod is disposed at the eighth coupling portion, wherein another end of the right front support rod is pivotally disposed at the seventeenth pivotal connection portion, wherein another end of the right rear support rod is pivotally disposed at the eighteenth pivotal connection portion, wherein the right hanging portion is disposed at the second rest portion.

* * * * *